US006035910A

United States Patent [19]

Schaefer

[11] Patent Number: 6,035,910

[45] Date of Patent: Mar. 14, 2000

[54] PROCESS AND APPARATUS FOR PRODUCING NARROW VENEER STRIPS

[75] Inventor: Karl Schaefer, Lechbruck, Germany

[73] Assignee: Inter-Wood Maschinen GmbH & Co. KG, Lechbruck am See, Germany

[21] Appl. No.: 09/105,271

[22] Filed: Jun. 26, 1998

[30] Foreign Application Priority Data

Jun. 26, 1997 [DE] Germany ..... 197 27 127

[51] Int. Cl.[7] ..... B27L 5/02; B27L 7/00

[52] U.S. Cl. ..... 144/369; 144/3.1; 144/176; 144/242.1; 144/245.1; 144/250.13; 144/250.14; 144/250.17; 144/42

[58] Field of Search ..... 144/1.1, 3.1, 37, 144/39, 41, 367, 369, 370, 42, 43, 242.1, 245.1, 245.5, 245.3, 245.4, 250.12, 250.13, 250.14, 250.17, 250.16

[56] References Cited

U.S. PATENT DOCUMENTS 3,415,297 12/1968 Yock ..... 144/176
4,061,819 12/1977 Barnes .
4,572,256 2/1986 Rautio ..... 144/39
4,599,929 7/1986 Dutina ..... 144/39

FOREIGN PATENT DOCUMENTS 195 04 030 7/1996 Germany .
WO 96/24473 8/1996 WIPO .

OTHER PUBLICATIONS

Zentralblatt, "Eine Schnittgut–Spannvorrichtung für das Gatter" *Neu auf dem Markt* (1997).

*Primary Examiner*—W. Donald Bray
*Attorney, Agent, or Firm*—Foley & Lardner

[57] ABSTRACT

The invention relates to a process and apparatus for producing veneer strips of predetermined length, width and thickness from wood. The apparatus has a severing tool for dividing the wood to be machined into boards, a clamp for clamping the boards, and a machining device for machining the clamped boards into veneer strips.

15 Claims, 10 Drawing Sheets

PROCESS AND APPARATUS FOR PRODUCING NARROW VENEER STRIPS

FIELD OF THE INVENTION

The present invention relates to a process and an apparatus for producing narrow veneer strips. In particular, the present invention relates to a method and an apparatus for producing veneer strips of a predetermined length, width, and thickness from wood.

BACKGROUND OF THE INVENTION

Narrow veneer strips are typically used in the production of laminated veneer boards and beams, which are commercially available, for example, under the trade name PARALLAM®. Until now, the method for producing these veneer strips has been to peel relatively large diameter boles in veneer peeling machines and then to cut these peeled veneers, in so-called clippers, into strips of a length of approximately 80 cm. The strips have then been checked manually for flaws or attached pieces of branch. This production method is laborious and expensive.

To avoid this laborious and expensive production method, German Patent 195 04 030 C1 has proposed a process and an apparatus that make it possible to produce, in addition to the main product of a solid-wood beam, a secondary product of veneer strips from the edge regions of the bole. For this purpose, a severing tool, which may be designed as saws, is used to divide up the bole at intervals in its edge regions. These intervals correspond to the widths, transverse to the fiber direction of the bole, of the veneer strips to be produced. Thereafter, the bole prepared in this way is passed into the region of frustoconical cutter disks, which are constructed in the manner of the known profiling cutters. On these cutter disks, the cutters are offset helically with respect to one another, and the cutters, from the smallest cutting circle to the largest cutting circle, are set back with respect to the following (trailing) cutter by the thickness of one sliver, e.g., 1.5 mm.

Such cutter disks or profiling cutters have proven successful in the production of coarse chips, but are unsuitable for the production of narrow veneer strips of a length of 100 mm to 500 mm, because they do not have a wood-guiding surface. Without the wood-guiding surface it is not possible to make a severing cut for producing a uniform material thickness, especially at the high through-passage speeds of 50 m/min and above, as required in industry, without creating cracks in the direction in which the fibers run.

The process and apparatus explained in German Patent 195 04 030 C1 can only achieve reasonably uniform sliver thicknesses and crack-free veneer strips if the bole-advancement speed is reduced considerably. However, this reduced production time does not fulfill the requirements for cost-effective production.

SUMMARY OF THE INVENTION

The object of the present invention is thus to specify a process and an apparatus that allow cost-effective production of narrow veneer strips.

The present invention is directed to a process for producing veneer strips of predetermined length, width, and thickness from wood, effected by cutting the wood into boards each having a thickness corresponding to the width, which is typically transverse to the fiber, of the veneer strips to be produced. The boards are then clamped together. The clamped boards are then machined to form the veneer strips.

According to the invention, one or more boles can be processed at the same time. The boles can be processed while disposed one beside the other or one above the other. The bole can be cut, horizontally or vertically, into boards using saws, horizontally or vertically. Depending how the machining is carried out, the clamped boards can be rotated through 90° about their longitudinal axes before they are machined into veneer strips. The machining can be effected with at least one cutter disk, which can be a planar or frustoconical cutter disk. Preferably, the boards are machined with two frustoconical cutter disks disposed opposite one another.

The present invention is also directed to an apparatus for producing veneer strips of predetermined length, width, and thickness from wood. The apparatus includes a severing tool for dividing wood to be machined into a plurality of boards, a clamp for clamping the boards together, and a machining device for machining the clamped boards into veneer strips.

The severing tool can comprise frame saws or a multi-blade circular saw that produces horizontal or vertical cuts. Depending on how the machining device is positioned, a turning device can be used to turn the clamped boards through 90° about their longitudinal axes to horizontally position the cut boards.

The machining device includes at least one cutter disk, which can be a planar or frustoconical cutter disk. Preferably, the machining device comprises two frustoconical cutter disks disposed opposite one another, each cutter disk being disposed at one side of the clamped boards. According to the invention, each cutter disk can be provided with a plurality of cutters that are offset helically with respect to one another. The cutter positioned from a smallest cutting circle to a largest cutting circle is set back with respect to the trailing cutter by a thickness of one veneer strip.

Each cutter can include a main cutting edge disposed transversely with respect to a direction of rotation of the cutter disk and a secondary cutting edge disposed in the direction of rotation. A trailing end of the secondary cutting edge is preferably set back with respect to a leading end of the secondary cutting edge. The secondary cutting edge between the trailing end and the leading end can be rectilinear or curved. The curve can be parabolic or circular.

According to the invention, each cutter can be retained on a cutter carrier so as to allow the cutter to be displaceable both parallel to and perpendicularly with respect to the main cutting edge.

The cutter carriers can include oblique or curved slits for adjusting the cutters. The secondary cutting edge of each cutter can project laterally beyond the respective cutter carrier. Each cutter carrier can also include an adjustable bridge forming a sliver through-passage slit. A wood-guiding surface can be provided upstream of each cutter. The wood-guiding surface can comprise an exchangeable stump cutter.

At least one scoring knife can be disposed in the region of each secondary cutting edge. Each secondary cutting edge can have a wedge angle less than approximately 30°. Each cutter disk can be provided with sliver through-passage slits.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DETAILED DESCRIPTION OF THE PREFERRED EMBODIMENTS

Figure 1:
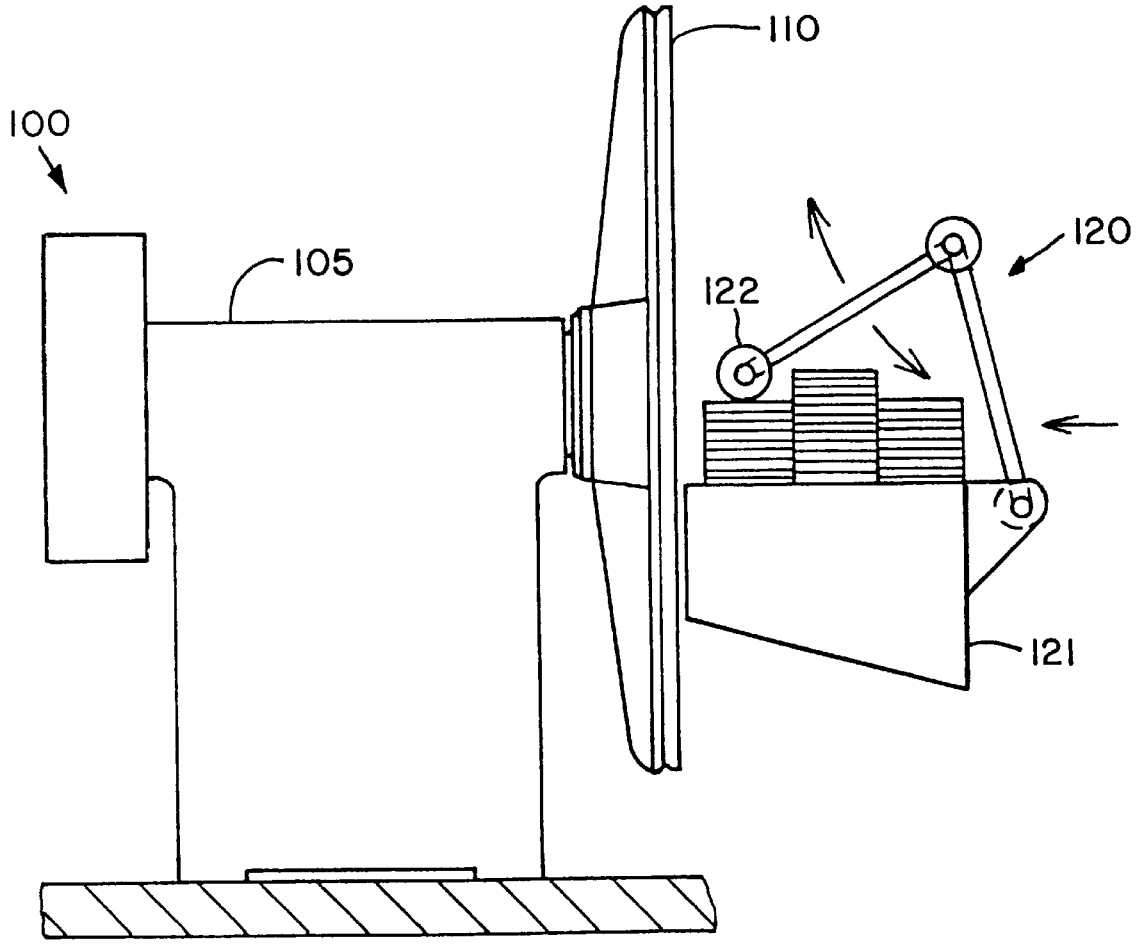
FIG. 1 shows an overall view of a first embodiment of an apparatus according to the invention for producing narrow veneer strips.

The veneer strips produced according to the apparatus and the method of the present invention can be used to produce chipwood beams with quality characteristics, which were not possible until now. The chipwood beams not only equal the peeled-veneer chipwood beams in quality, but also can be produced considerably more cost-effectively. The process according to this invention produces veneer strips, which have been predefined precisely in terms of length, width, and thickness cost-effectively, even at high through-passage speeds.

The process includes dividing up wood to be machined into a cut-wood arrangement, i.e., boards. The thickness of the boards produced corresponds to the width, transverse to the fiber, of the veneer strips to be produced. Thereafter, the boards are retained by a clamp. This prevents the individual boards from slipping to maintain their relative positions. The clamped boards are then machined using a machining device to form the desired veneer strips.

The process according to the invention and the apparatus according to the invention can be used to process not just a single bole, but also a plurality of boles at the same time. In that case, the boles can be arranged, for example, one beside the other or one above the other.

According to one advantageous development, the wood can be divided up either by horizontal severing cuts or by vertical severing cuts. Saws may be used for this purpose, e.g., frame saws or circular saws. Depending on the machining device used, it may be necessary for the boards to be turned through 90° about their longitudinal axis before to the machining operation.

Once the wood has been divided up into boards, they are held together by a clamp. Such a clamp can be, for example, as described in "Holz-Zentralblatt," no. 60/61 dated May 21, 1997, page 923.

The wood held together in this way is then fed to the machining device, which may comprise an essentially planar cutter disk or a frustoconical cutter disk. To achieve relatively high machining performance, it is possible, according to one particular embodiment, for two cutter disks to be provided on opposite sides of the boards to be machined.

If the machining device is designed as a cutter disk, it is preferably provided with cutters that are offset helically with respect to one another. In this embodiment, each cutter, from the smallest cutting circle to the largest cutting circle, is preferably set back with respect to the trailing cutter by the thickness of one sliver. Each cutter has a main cutting edge, which runs transversely with respect to the direction of rotation of the cutter disk, and a secondary cutting edge, which runs in the direction of rotation. The trailing end of the secondary cutting edge is set back with respect to the leading end of the secondary cutting edge.

This configuration of the cutter removes the secondary cutting edge out of the way of the advancing wood, with the result that the wood can be advanced without obstruction, and the narrow sides of the veneer strips are no longer subjected to an impermissible amount of pressure. The amount by which the trailing end of the secondary cutting edge is set back with respect to the leading end of the secondary cutting edge has to be determined in dependence on the bole-advancement speed and the cutter-disk rotational speed.

According to a further advantageous configuration, the secondary cutting edge progresses in a rectilinear or curved manner between the trailing end and the leading end. In this case, the curved progression may be parabolic or circular.

To permit precise adjustment of the cutters once they have been resharpened, each cutter can be retained on a cutter carrier so as to be displaceable both parallel to, and perpendicularly with respect to, the main cutting edge. For this purpose, the cutter carrier has oblique or curved slits. The slit enables the cutter to be easily displaced in both directions.

According to a further advantageous configuration, the secondary cutting edge projects laterally beyond the cutter carrier to ensure that it engages the wood.

The cutter carrier may be designed as an adjustable bridge and may form a sliver through-passage slit beneath itself. Consequently, the cutter disk may be designed cost-effectively as a smooth continuous disk.

To prevent the wood from being drawn in beneath the cutter, it is possible, according to a further advantageous configuration, for a wood-guiding surface to be provided upstream of the cutter. This wood-guiding surface may be designed as an exchangeable stump cutter.

At least one scoring knife may be arranged upstream of each cutter to ensure reliable severing of the veneer strips. The scoring knife is arranged, in particular, in the region of the secondary cutting edge.

To enable the secondary cutting edge to penetrate into the wood without a large amount of force being exerted, the wedge angle of the secondary cutting edge should, to the extent possible, be smaller than approximately 30°.

To achieve particularly good deflection of the veneer strips, the cutter disk may also be provided with sliver through-passage slits.

Figure 10:
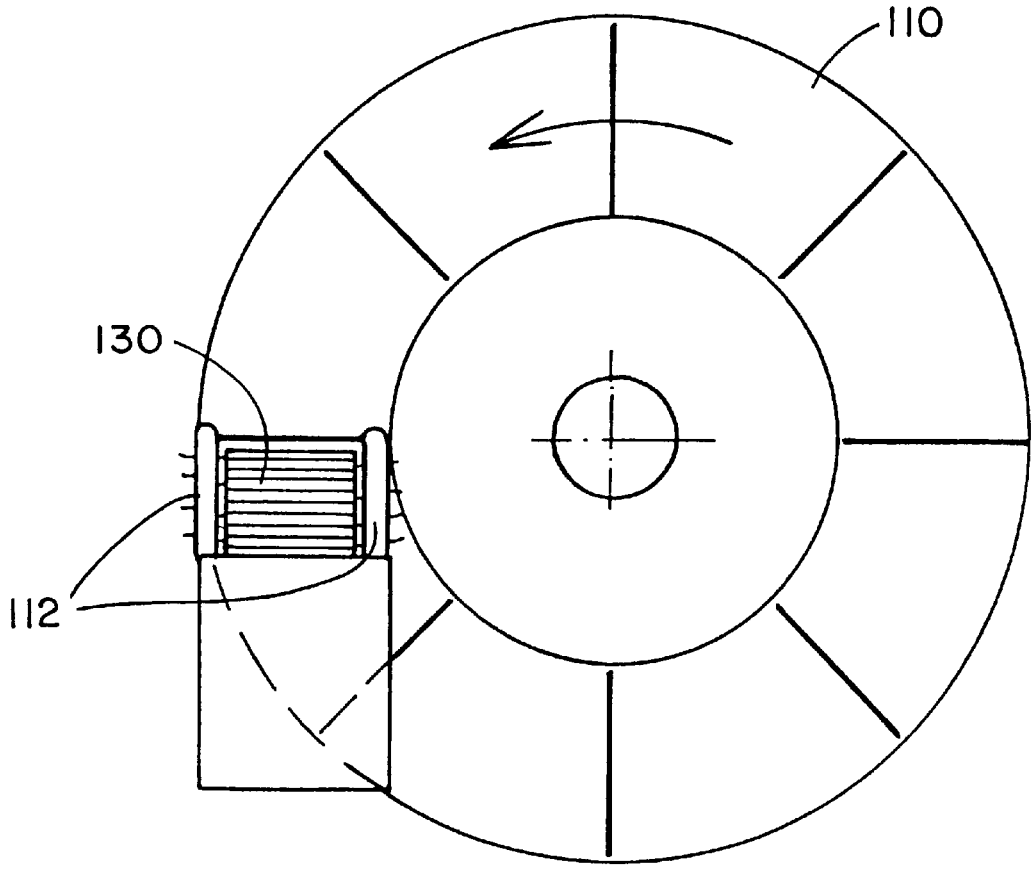
FIG. 10 shows a front view of the planar disk.
Figure 11:
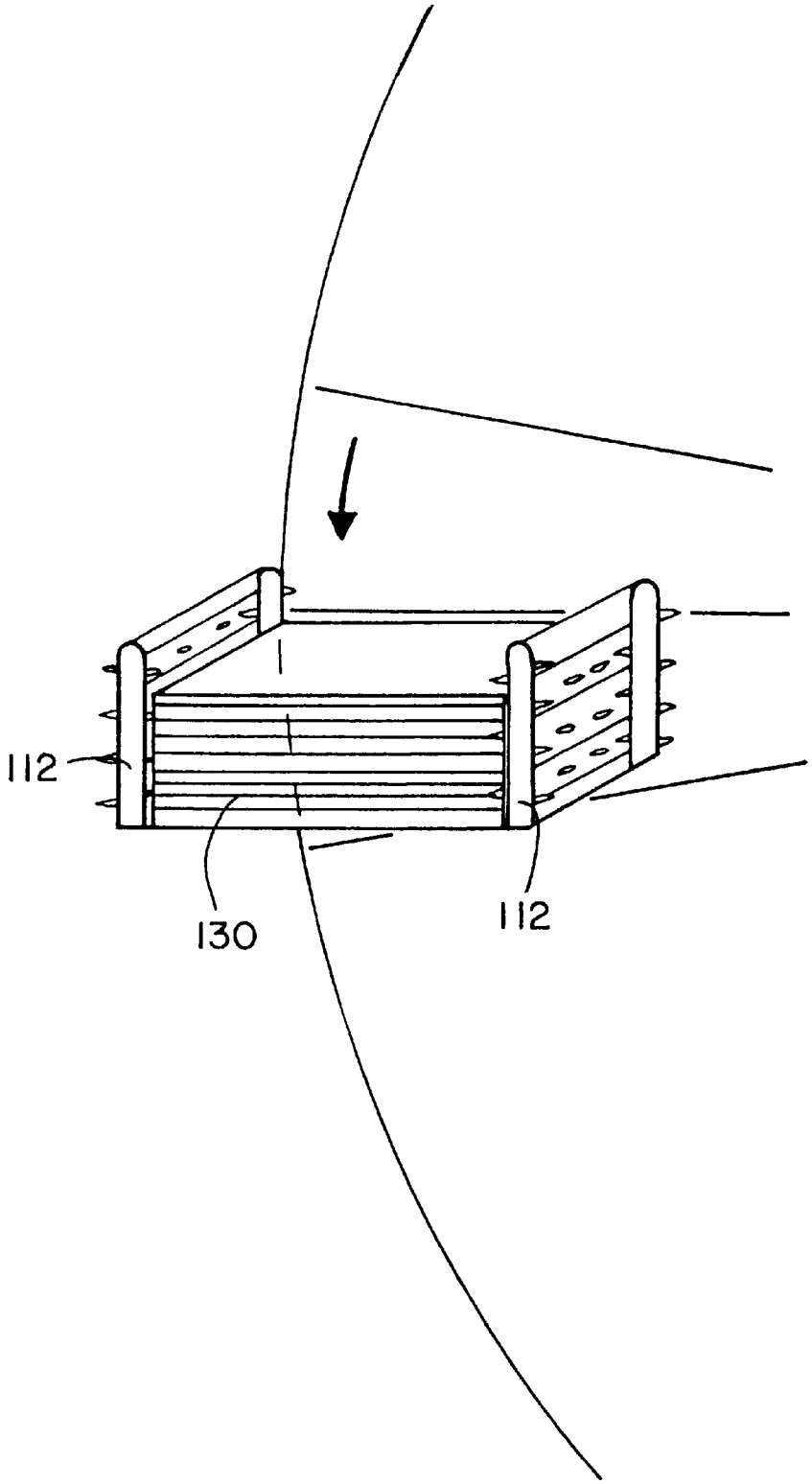
FIG. 11 shows an exploded view of the feeding device.

FIG. 1 illustrates an overall view of a first embodiment of the invention for producing veneer strips from wood. A wood cutting apparatus 100 includes a planar disk 110 driven by a motor 105 (not shown in detail). In this embodiment, wood boards 130 are forced against the planar disk 110, which rotates and slices boards 130 into veneer strips. The boards 130 are placed on a loading device 120, which includes a carrier 121 and a press rollers 122. The boards 130 are pushed against the disk 110, for example, using lateral chain walls 112. See FIGS. 10 and 11. In this embodiments, the boards can be, for example, obtained by dividing boles or logs into 400 mm long sections, squared on all four sides. The boards can be divided into stacked board packages, as shown in FIG. 1. The packages can be continuously urged against the planar disk 110.

Figure 2:
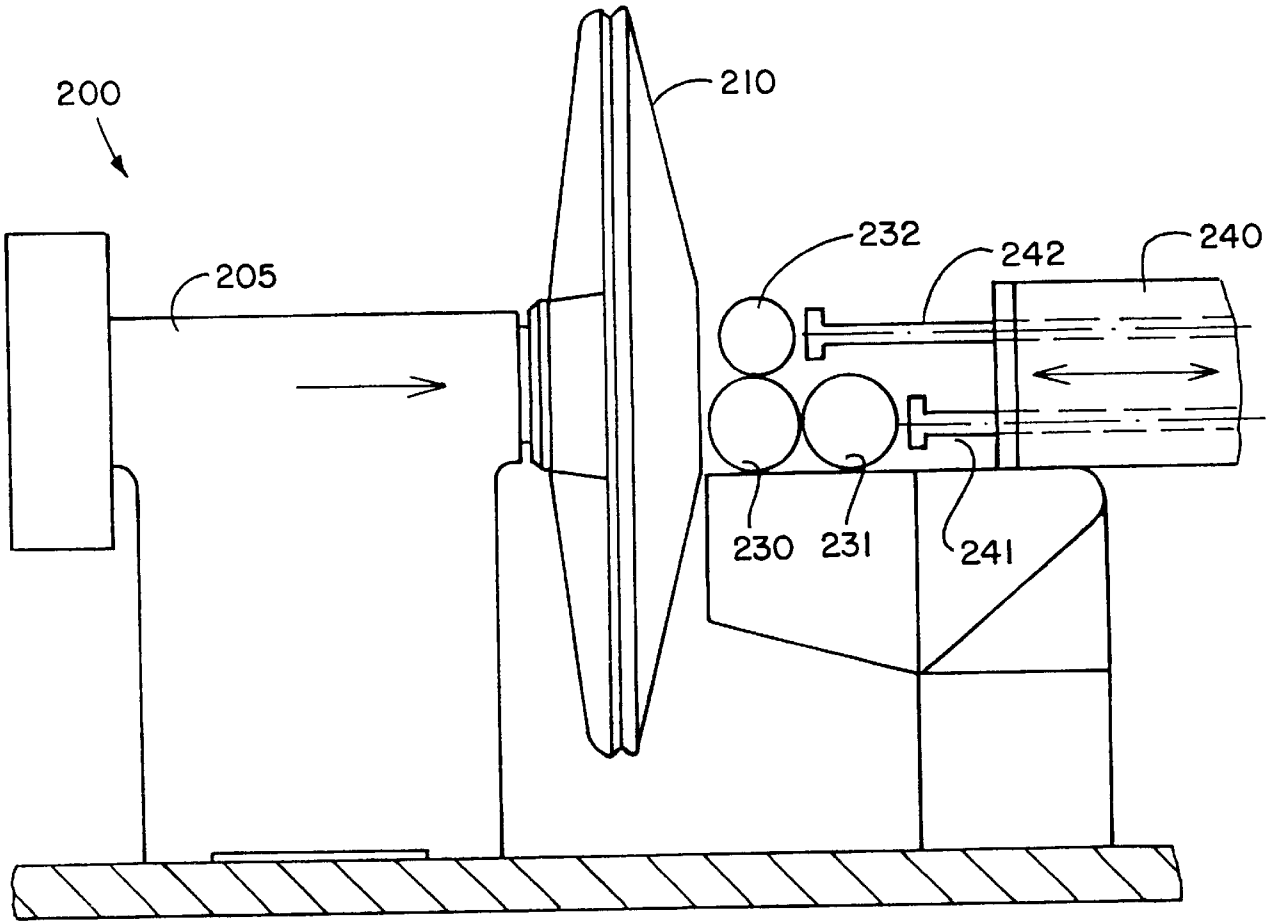
FIG. 2 shows an overall view of a second embodiment of an apparatus according to the invention for producing narrow veneer strips.

FIG. 2 shows a second embodiment of the present invention. The wood cutting apparatus 200 includes a motor 205 for driving a frustoconical disk 210. In this embodiment, processed logs 230 are pressed against the rotating frustoconical disk 210 using a pressing device 240, which is shown with two vertically stacked pushers 241, 242, such that logs 230, 231, and 232 are sliced into veneer strips (as described hereinafter). The logs 230, 231, and 232 are cut along their length across the disk 210. As shown, a second log may be placed beside (231) or on top (232) of the log 230. While the lower presser 241 is relaxed (withdrawn), a second log 231 may be introduced behind the first log 230, while the second presser 242 can force the third log 232 against the disk 210. Therefore, the logs can be alternately processed. Both pressers 241, 241, however, can be activated simultaneously to act on both the upper and the lower logs 232, 230.

Figure 3:
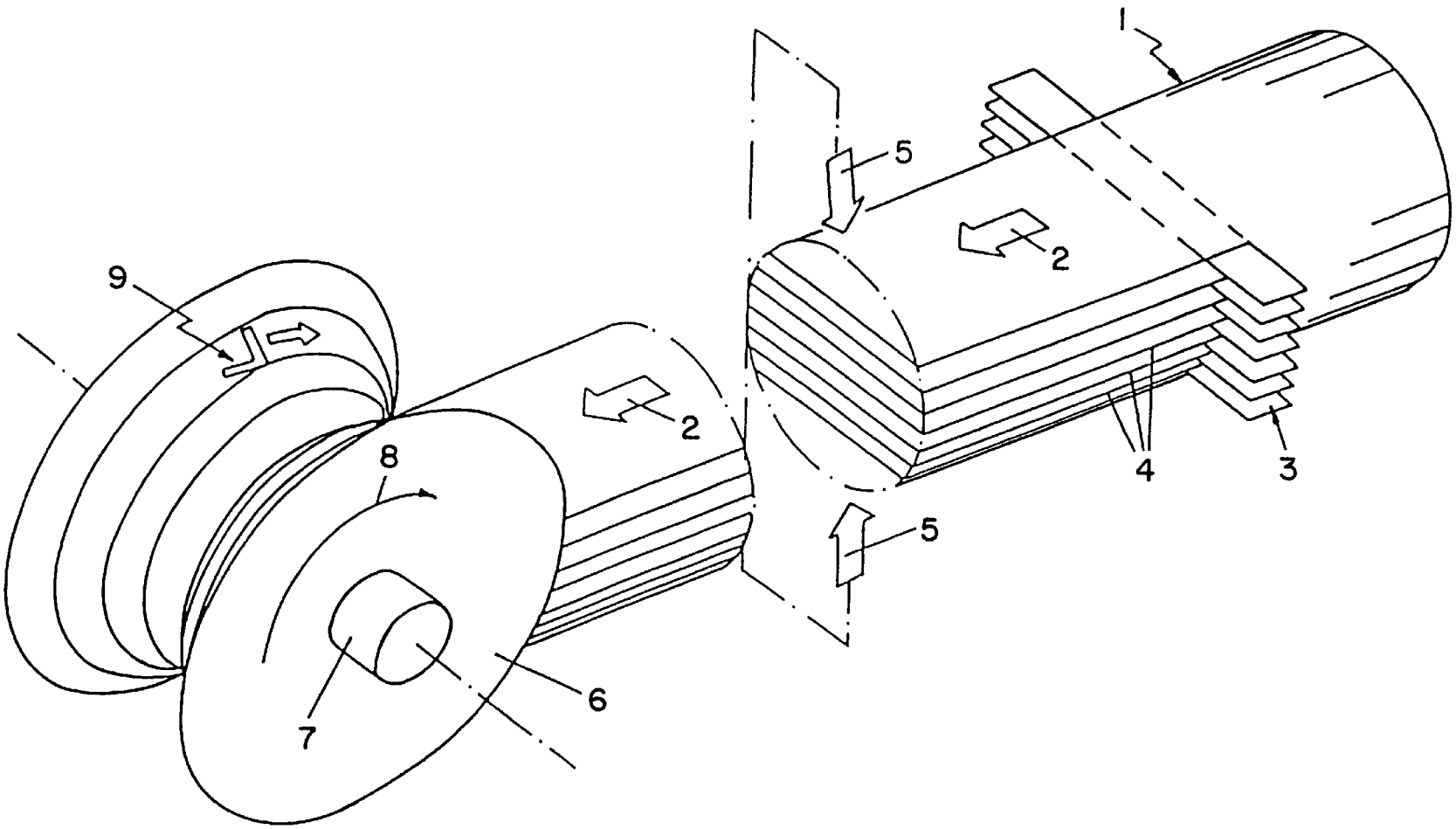
FIG. 3 shows a perspective view of a portion of the third embodiment of an apparatus according to the invention for producing narrow veneer strips.

FIG. 3 illustrates an overall view of another embodiment of the invention, for producing narrow veneer strips according to the invention. Wood 1, e.g., one or more boles, is transported in the direction of the arrows 2 by a conventional advancement device (not shown), and guided past a severing tool 3, which comprises, for example, saws, e.g., frame saws or circular saws. This severing tool 3 produces horizontal cuts and subdivides the wood 1 into boards 4. The thickness (e.g., 20 mm) of the boards corresponds in the direction transverse to the fiber direction of the veneer strips to be produced.

The boards produced in this way are then held together by a clamp 5 (only schematically illustrated). The clamp maintains the mutual positions of the boards 4 while they pass to a machining device 6, in which the entire boards can be machined to form narrow veneer strips.

In the first exemplary embodiment, the machining device 6 comprises two mutually opposed frustoconical cutter disks, which are preferably designed as a profiling cutter and rotate about a horizontal axis. Instead of the frustoconical cutter disks, however, it is also possible to use planar cutter disks.

Figure 5:
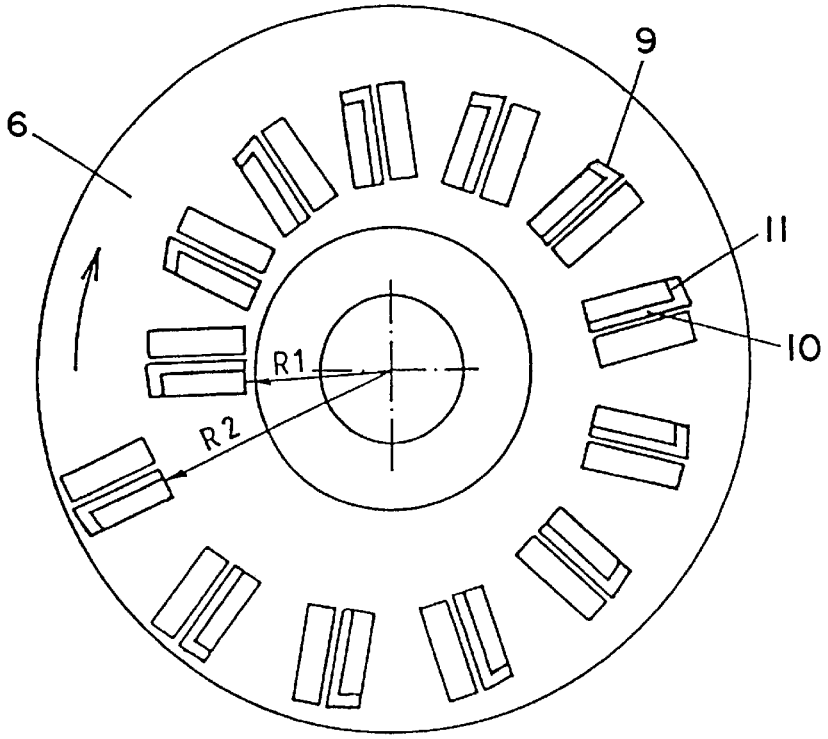
FIG. 5 shows a plan view of a cutter disk for producing narrow veneer strips.

The two frustoconical cutter disks are driven in the direction of rotation 8 by shafts 7. Cutters 9, which are offset helically with respect to one another, are arranged on the machining surface of the cutter disks. See FIG. 5. Each cutter 9, from the smallest cutting circle R1 to the largest cutting circle R2, is set back with respect to the trailing cutter 9 by the thickness of one sliver in each case, e.g., 1.5 mm.

The cutters 9 have a main cutting edge 10, which is arranged transversely with respect to the direction of rotation 8, and a secondary cutting edge 11, which runs in the direction of rotation 8. To prevent the advancing wood 1 from being pushed against the secondary cutting edge 11 during the cutting operation, the cutter 9 is designed in the manner illustrated in FIGS. 6 and 7.

Figure 6:
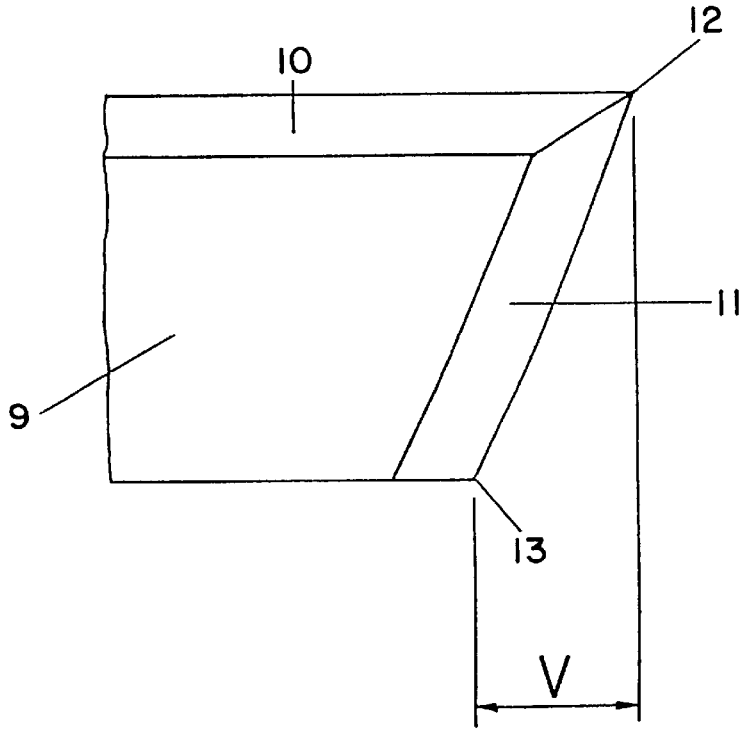
FIG. 6 shows an enlarged view of a cutter for use in the cutter disk.

The cutter 9 is fastened on the cutter disk such that the main cutting edge 10 runs transversely with respect to the direction of rotation 8 and the secondary cutting edge 11 runs substantially in the direction of rotation 8. Moreover, the trailing end 13 of the secondary cutting edge 11 is set back (by amount V) with respect to the leading end 12 of the secondary cutting edge 11. The set back amount V is determined based on the bole-advancement speed and the cutter-disk rotational speed. Although the secondary cutting edge 11 is illustrated in FIG. 6 as progressing between the leading end 12 and the trailing end 13 in the form of an arc of a circle, this progression may also be parabolic or rectilinear (FIG. 7).

Figure 7:
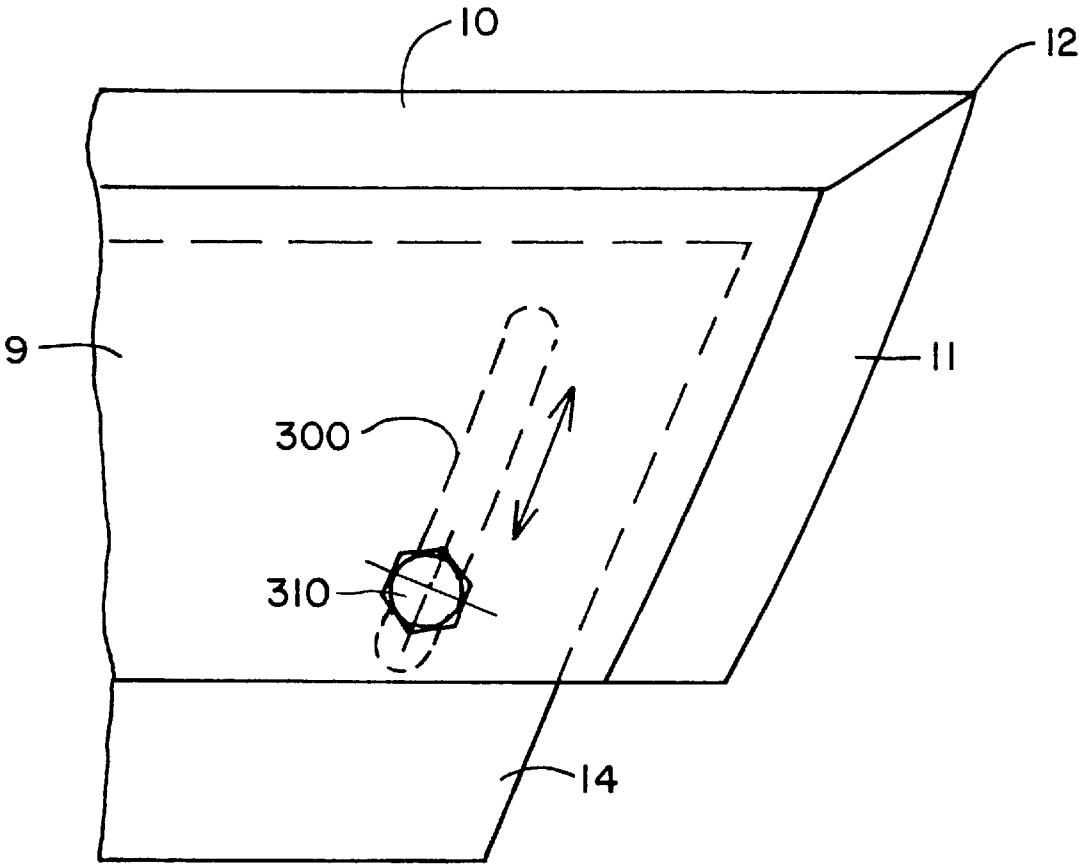
FIG. 7 shows a side schematic view of the cutter.

As shown in FIG. 7, in order that the cutters 9 can be adjusted correctly in terms of both the main cutting edge 10 and the secondary cutting edge 9 after they have been resharpened, the cutters 9 can be retained on a cutter carrier 14 so as to be displaceable both parallel to, and perpendicularly with respect to, the main cutting edge 10. For this purpose, for example, oblique or curved slits 300 may be provided in one of the cutter carriers 14 and the cutters 9 and holes in the other of the cutter carriers 14 and the cutters 9, with a bolt assembly 310 for locking the cutters in place, or else the cutter carrier 14 may be designed as an adjustable bridge. As shown in FIG. 7, the cutter 9 has the hold and the carrier has the slits 300. The latter configuration would have the further advantage of it being possible for the veneer strips to be guided away beneath the cutter 9 by way of the bridge. See FIG. 8. As an alternative, or in addition, the cutter disk can include sliver through-passage slits 301 (FIG. 8).

Figure 8:
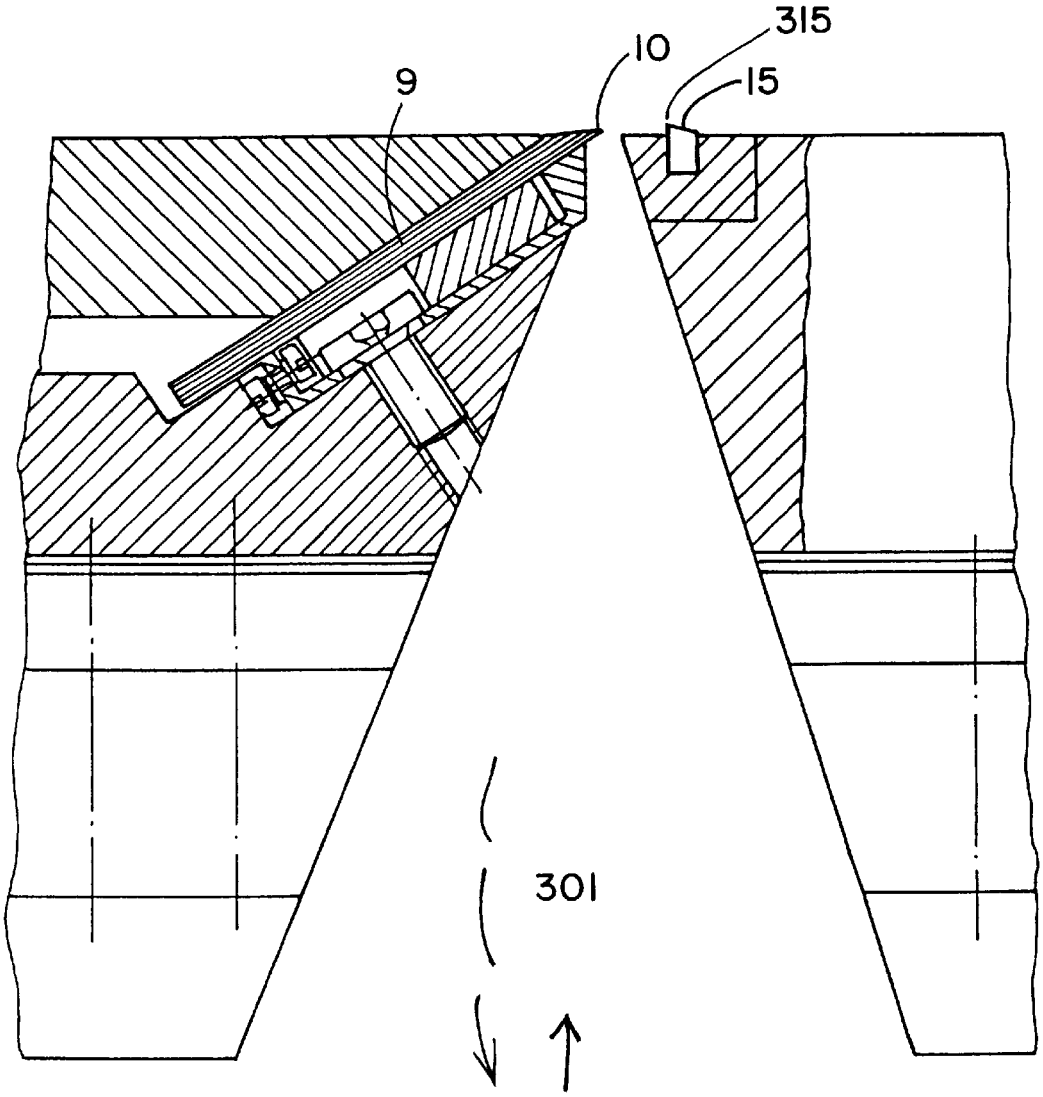
FIG. 8 shows a side schematic view of the cutter as installed.
Figure 9:
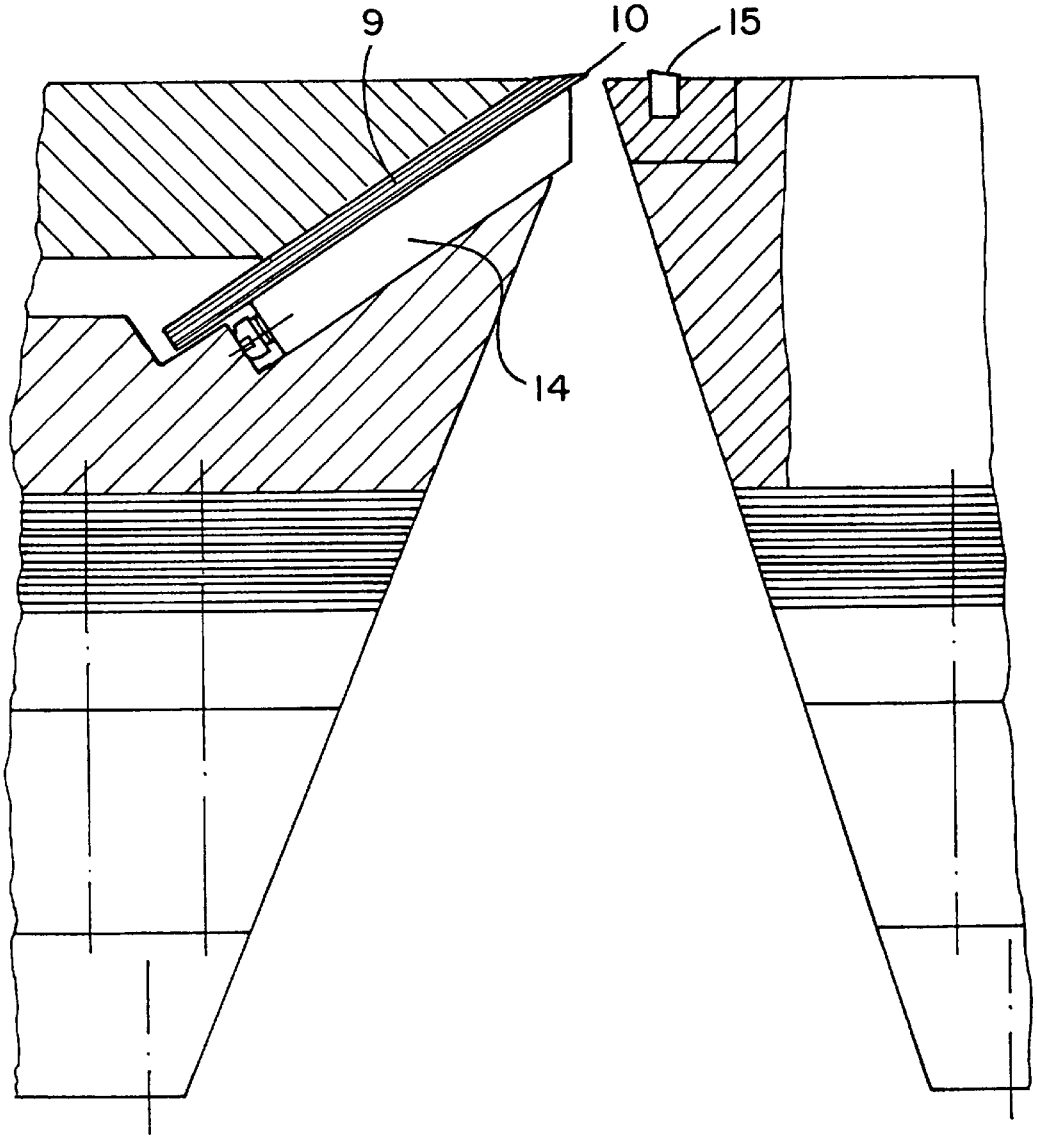
FIG. 9 shows a side schematic view of the cutter as installed in the frustoconical disk.

To prevent the severed veneer strips from being drawn in beneath the cutters 9, a wood-guiding surface 15 having scoring knives 315 is provided upstream of each cutter 9, the surface being designed as an exchangeable stump cutter in the illustration according to FIG. 8. The scoring knives 315 are to ensure that the veneer strips are severed cleanly.

Figure 4:
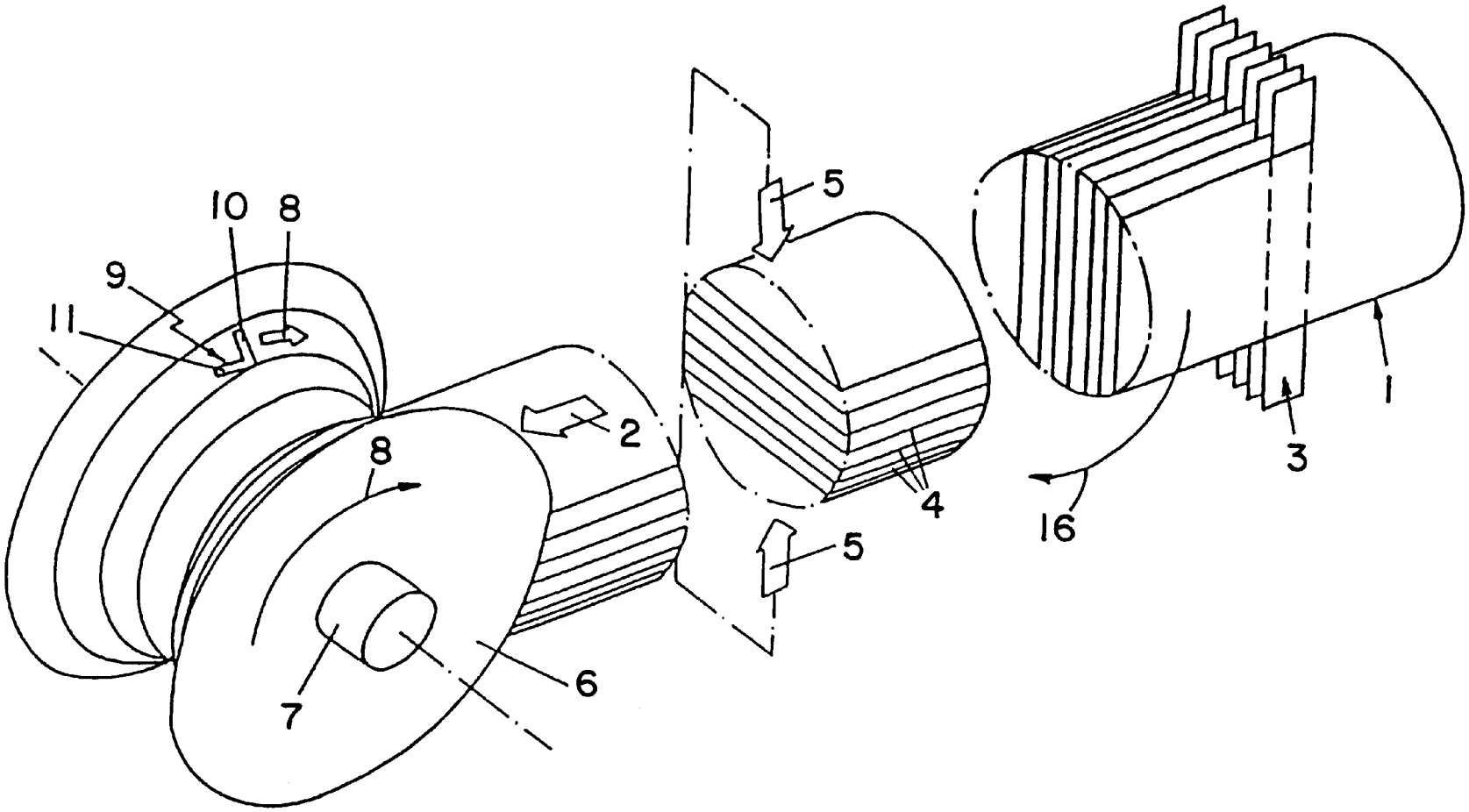
FIG. 4 shows a portion of a fourth embodiment of an apparatus according to the invention for producing narrow veneer strips.

Another embodiment according to the present invention is illustrated in FIG. 4. Whereas, in the embodiment according to FIG. 3, the severing tool 3 produces horizontal cuts, the embodiment according to FIG. 4 provides a severing tool 3 that produces vertical cuts. In order that the boards produced in this way can be machined in the desired manner by the frustoconical cutter disks, as has been explained in conjunction with the embodiment of FIG. 3, a turning device 16 (only illustrated as an arrow in the drawing) is positioned downstream of the severing tool for turning the boards through 90° about their longitudinal axes. This positions the individual boards 4 horizontally. The turned boards are then machined, as has been described in conjunction with FIG. 3.

Depending on the machining device 6 used, it is possible in some circumstances, with vertically running severing cuts, to dispense with the turning device 16, e.g., if the cutter disks rotate about vertical axes. On the other hand, an appropriate machining device 6 may render a turning device 16 necessary even in the case of horizontal severing cuts, as illustrated in FIG. 3.

Although the present invention has been described with reference to preferred embodiments, workers skilled in the art will recognize that changes may be made in form and detail without departing from the spirit and scope of the invention.

I claim:

1. A process for producing veneer strips of predetermined length, width, and thickness from wood, comprising:

cutting the wood boards so that each board has a thickness corresponding to the predetermined width, the predetermined width being transverse to the fiber of the veneer strips to be produced;

clamping the boards together; and machining the clamped boards to form the veneer strips.

2. The process of claim 1, wherein the wood includes at least one bole.

3. The process of claim 1, wherein the wood includes a plurality of boles processed at the same time.

4. The process of claim 3, wherein the boles are processed while disposed one above the other.

5. The process of claim 1, wherein the boards are cut vertically.

6. The process of claim 5, further comprising rotating the clamped boards through 90° about their longitudinal axes before machining the clamped boards.

7. The process of claim 3, wherein the boles are processed while disposed one beside the other.

8. The process of claim 1, wherein the wood is cut into boards using saws.

9. The process of claim 1, wherein the boards are cut horizontally.

10. The process of claim 9, further comprising rotating the clamped boards through 90° about their longitudinal axes before machining the clamped boards.

11. The apparatus of claim 1, wherein the severing tool comprises frame saws.

12. The apparatus of claim 1, wherein the severing tool produces horizontal cuts.

13. The apparatus of claim 12, further including a turning device for turning the clamped boards through 90° about their longitudinal axes.

14. The apparatus of claim 1, wherein the severing tool comprises circular saws.

15. The apparatus of claim 1, wherein the severing tool produces vertical cuts.

* * * * *